US008746523B1

(12) United States Patent
Woolley

(10) Patent No.: US 8,746,523 B1
(45) Date of Patent: Jun. 10, 2014

(54) TWO WAY CONVERTIBLE SHOULDER STRAP CONSTRUCTION

(75) Inventor: Stephanie Janine Woolley, Philadelphia, PA (US)

(73) Assignee: Stephanie J. Woolley, Philadelphia, PA (US)

( * ) Notice: Subject to any disclaimer, the term of this patent is extended or adjusted under 35 U.S.C. 154(b) by 667 days.

(21) Appl. No.: 13/385,786

(22) Filed: Feb. 16, 2011

(51) Int. Cl.
*A45F 3/04* (2006.01)

(52) U.S. Cl.
USPC ..... 224/578

(58) Field of Classification Search
USPC ..... 224/578, 579, 575, 656; 150/108; D3/244
See application file for complete search history.

(56) References Cited

U.S. PATENT DOCUMENTS

| | | | | | |
|---|---|---|---|---|---|
| 4,810,102 | A * | 3/1989 | Norton | 383/4 |
| 4,887,751 | A * | 12/1989 | Lehman | 224/579 |
| 5,415,332 | A * | 5/1995 | Kliot | 224/153 |
| 5,577,652 | A * | 11/1996 | Cooper | 224/578 |
| 5,927,581 | A * | 7/1999 | Reddy et al. | 224/578 |
| 6,220,493 | B1 * | 4/2001 | Iijima et al. | 224/578 |
| 6,390,345 | B1 * | 5/2002 | Brown et al. | 224/578 |
| 8,028,879 | B2 * | 10/2011 | Amishay | 224/578 |
| 8,231,037 | B2 * | 7/2012 | Sacks | 224/579 |
| 8,281,970 | B2 * | 10/2012 | Demskey | 224/579 |

* cited by examiner

*Primary Examiner* — Justin Larson

(57) ABSTRACT

A Two way, convertible shoulder strap construction worn over one shoulder were the strap winds around the user's chest or as an alternative to wear the shoulder strap over both shoulders. The Two way, convertible shoulder strap construction is affixed to a main body or an outer shell used to transport objects or materials, but not limited to, a tote, backpack, book bag, knapsack, back sack, rucksack, cinch sack, satchel, haversack, luggage, purse or any like item.

2 Claims, 16 Drawing Sheets

TWO WAY CONVERTIBLE SHOULDER STRAP CONSTRUCTION

BACKGROUND OF THE INVENTION

In prior art, cinch sacks used to carry items on one's back, use rope, cord or string for shoulder straps. Shoulder straps on these types of bags are tied in a knot or secured at the bottom right and left sides of the bag. The shoulder straps can easily detach and break away from the bottom making the shoulder straps unusable. The shoulder straps on these types of bags only have one option for the user to wear strapped onto both shoulders.

The present invention relates to, the Two way convertible shoulder strap construction which allows the user to carry an item used to transport objects or materials with the shoulder straps over one shoulder were the strap winds around the chest or worn aver both shoulders. The shoulder straps can be adjusted to fit most body sizes or changed to wear on the right shoulder or left shoulder of the user's body when choosing to wear on one shoulder with the strap winding around the user's chest. The use of the Two way, convertible shoulder strap construction can provide versatility for the user when using items that include a shoulder strap.

DESCRIPTION OF PREFERRED EMBODIMENTS

The detailed embodiments of the present invention are disclosed therein. The Two way, convertible shoulder strap construction may be constructed of any fabric material including, but not limited to any fabric material, neoprene, webbing, plastic, vinyl, leather, ribbon, metal, cord, rope or polyester. The strap either with or without length adjustment hardware may be used. The substitution of metal or plastic hardware, d rings, snaps, hooks, loops, locking devices, mating fasteners, various releasable fasteners or locking mechanisms in a variety of sizes are all variations within the scope of the invention.

The description of drawings shows an adjustable side release buckle on the embodiment of the invention to show a locking mechanism technique. The front end and second end of the strap may include a variety of sizes of several types of metal or plastic hardware or fastener devices.

The description of drawings shows a loop constructed of webbing and may be substituted with holes that are reinforced with grommets on the embodiment to describe the invention disclosed. These and other objects, advantages and features of the invention will be set forth in the detailed description which follows.

DETAILED DESCRIPTION OF INVENTION

The Two way, convertible shoulder strap construction 30,51,52,53 is affixed to a main body/outer shell 20 such as a cinch sack, but not limited to, a tote, backpack, book bag, knapsack, back sack, rucksack, satchel, haversack, luggage, purse, or any like item used to transport objects.

The main body/outer shell 20 may be constructed of synthetic material including, but not limited to fabric material, cotton, neoprene, plastic, vinyl, leather, pack cloth, nylon, polyester and may incorporate various designs, accessories, embellishments, colors, logos or trademarks.

The two way convertible shoulder strap construction 30, 51, 52, 53 may be constructed of webbing which can sustain a large amount of weight when it comes in contact with water, but not limited to, any fabric material, plastic, vinyl, ribbon, metal, cord, rope, leather, or synthetic material and may incorporate various embellishments, colors, designs, logos or trademarks.

An embodiment according to the present disclosure uses a circled, flexible, stretch band 42 attached to the bottom right side loop 53.

The loops 51, 52, 53 on the described embodiment of this invention can be constructed of holes, openings that may be reinforced by grommets or not, elastic, webbing, d-rings or metal or plastic hardware thus depicted in FIG. 14*a* and FIG. 14*b*.

The main body/outer shell 20 may have holes 70, openings with reinforcements or not or hardware such as a d-ring 80 used as fastener device as depicted in FIGS. 14 *a* and 14*b*.

The user has the option to wear the shoulder strap 30 over one shoulder 60 with a strap that winds around the user's chest resting the main body/outer shell on the user's back thus depicted in FIG. 11.

The user also has the option to wear the shoulder strap 30 over each shoulder 60, and the item so carried is centered on the back or chest, thus depicted in FIG. 6. Shoulder straps 30 can be adjusted to fit for comfort or not.

The two way, convertible shoulder strap construction allows the user to choose as a preference to wear on the left or right side of the shoulder just by flipping the main body/outer shell 20 over to the opposite side of the main body/outer shell 20 when the main body/outer shell 20 has similar sides on the front and back such as a cinch sack.

If the user, prefers to wear the two way, convertible strap construction over one shoulder 60 with the strap 30 that winds around the chest; the adjustable release buckle 40, 41 when unfastened, the male side of the buckle 40 passes through the top right side loop 52 and then fastened to the female side release buckle 41 at the bottom left side of the main body/outer shell 20 thus depicted in FIG. 10.

If the user prefers to wear the two way, convertible strap construction on both shoulders, the adjustable release buckle 40, 41 unfastened and the male side with teeth 40 passes through the bottom right side loop 42; then passes through the top center loop 51; and then fastened to the female side release buckle 41 affixed to the bottom left side creating a triangular shape appearance of the shoulder strap 30 thus depicted in FIG. 5. This allows the user to place arms through the right & left sides of the triangle figure shaped straps 30 to wear on both shoulders 60 with the main body/outer shell 20 facing the user's back, thus depicted in FIG. 7.

The disclosed embodiments are to explain the invention, which may be embodied in various forms. The details disclosed herein are not to be interpreted as limited; but merely a basis to teach how to make and/or use the invention.

Figure 1:
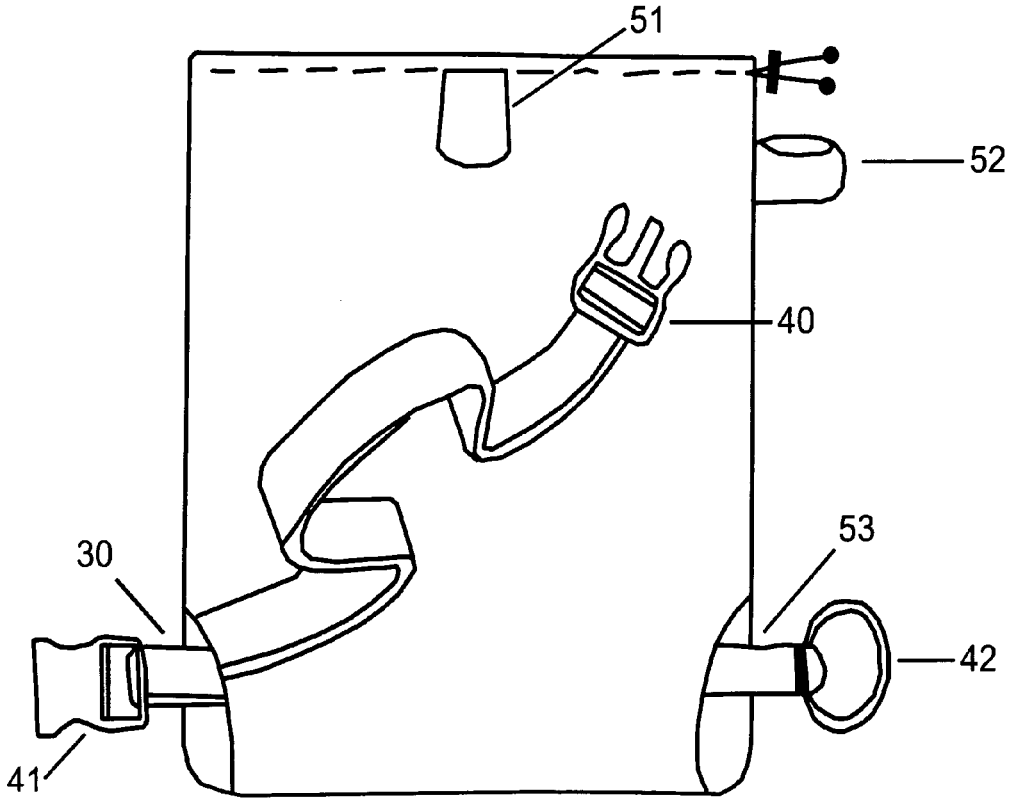
FIG. 1 is a perspective view of an embodiment showing the back view illustrating the two way, convertible shoulder strap construction wherein the strap utilizing a release buckle has been released to elongate the position wherein the loops are extended outward and are positioned on the top center, right top side and bottom right side attached to a flexible band.
Figure 2:
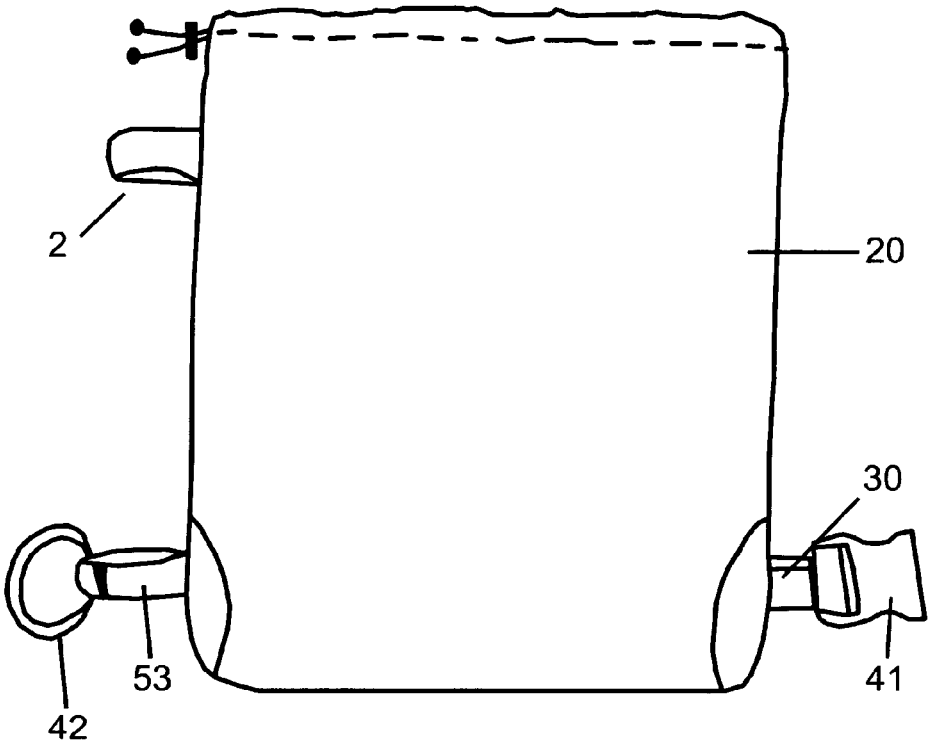
FIG. 2 is a perspective view of the front of an embodiment were the loops extend outward.
Figure 3:
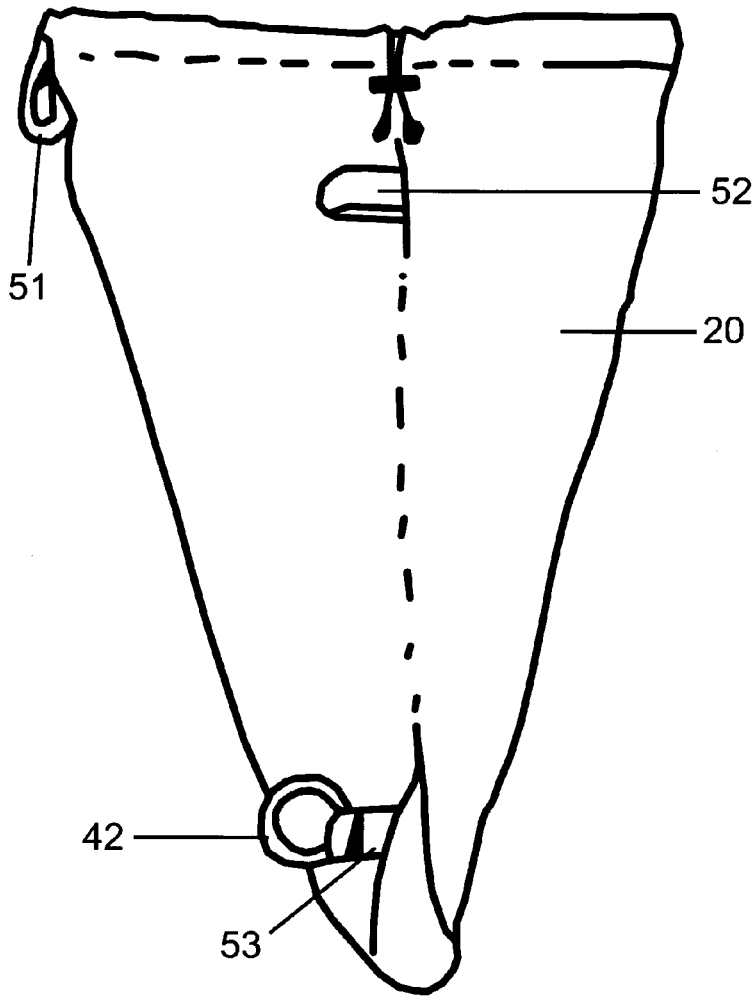
FIG. 3 is a right side elevation of one embodiment wherein the loop is affixed to a flexible band and the bottom right side.
Figure 4:
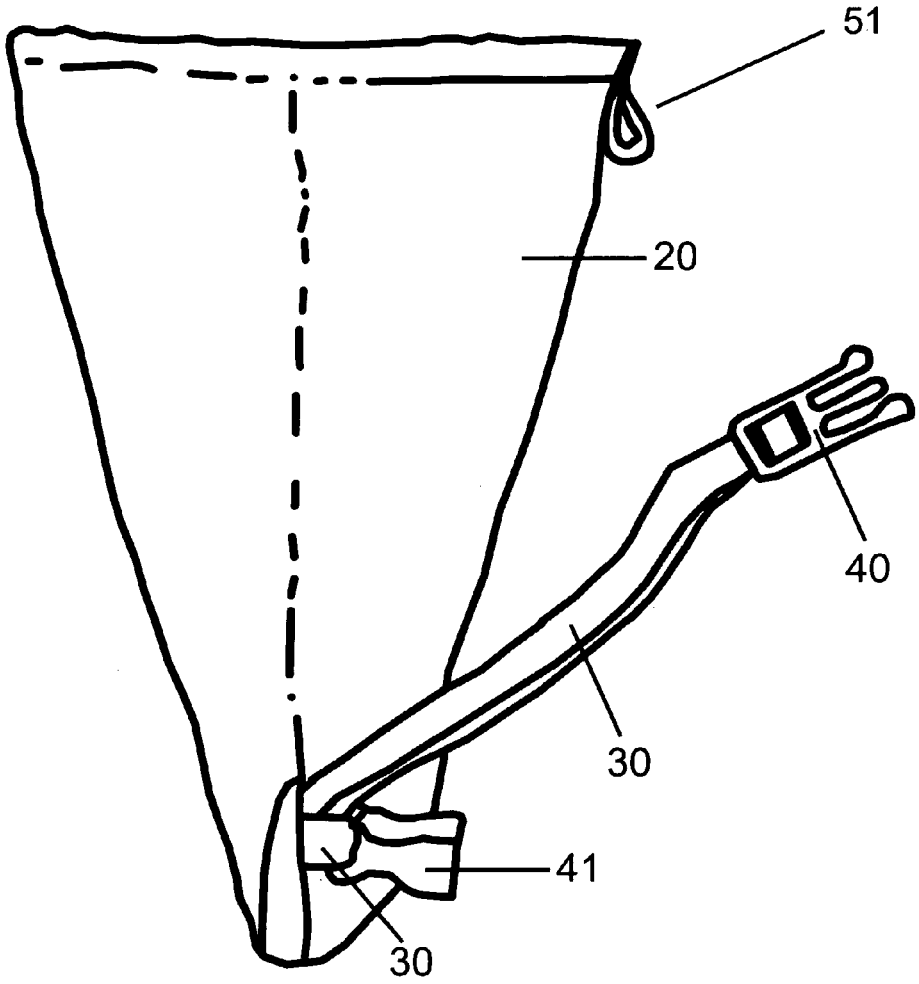
FIG. 4 is a left side elevation of one embodiment wherein the release buckle is affixed to the bottom left side, extended outward.
Figure 5:
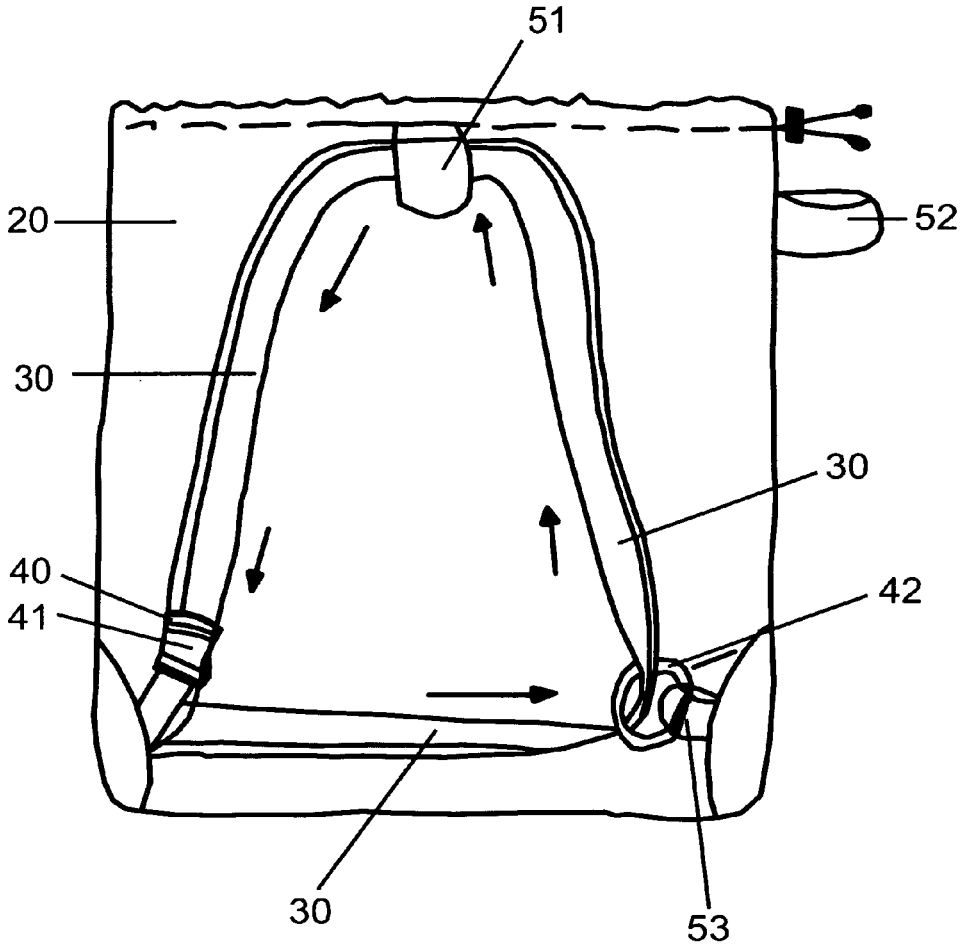
FIG. 5 is a front view of the shoulder strap construction showing the triangular configuration as one alternative to wear over both shoulders and the embodiment facing the user's back.
Figure 6:
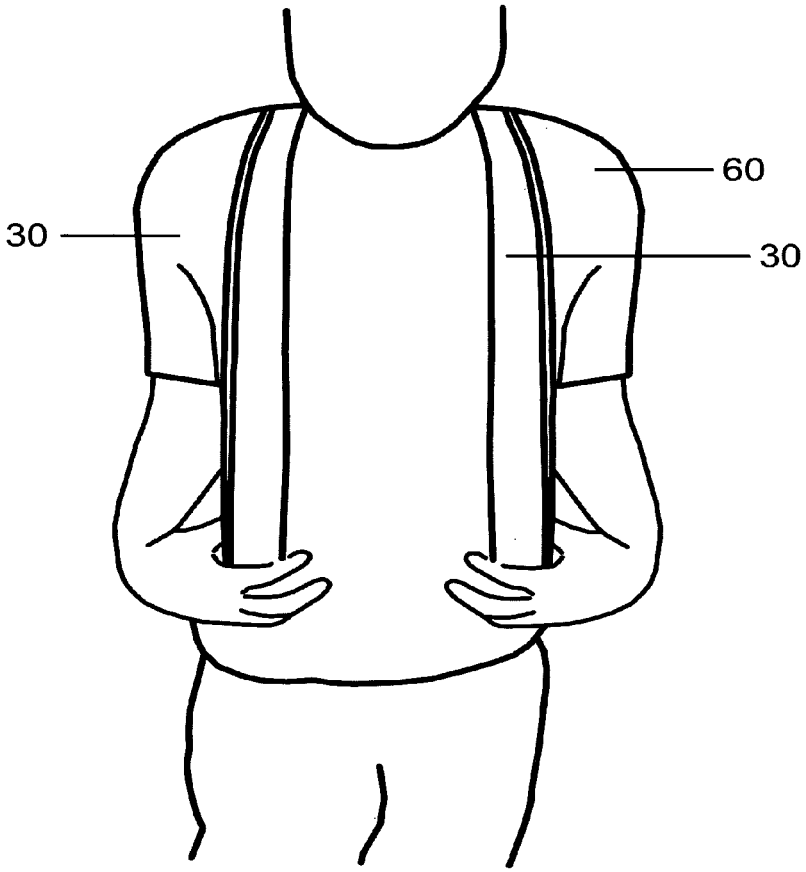
FIG. 6 is a front view of the shoulder straps, worn by a person, on both shoulders.
Figure 7:
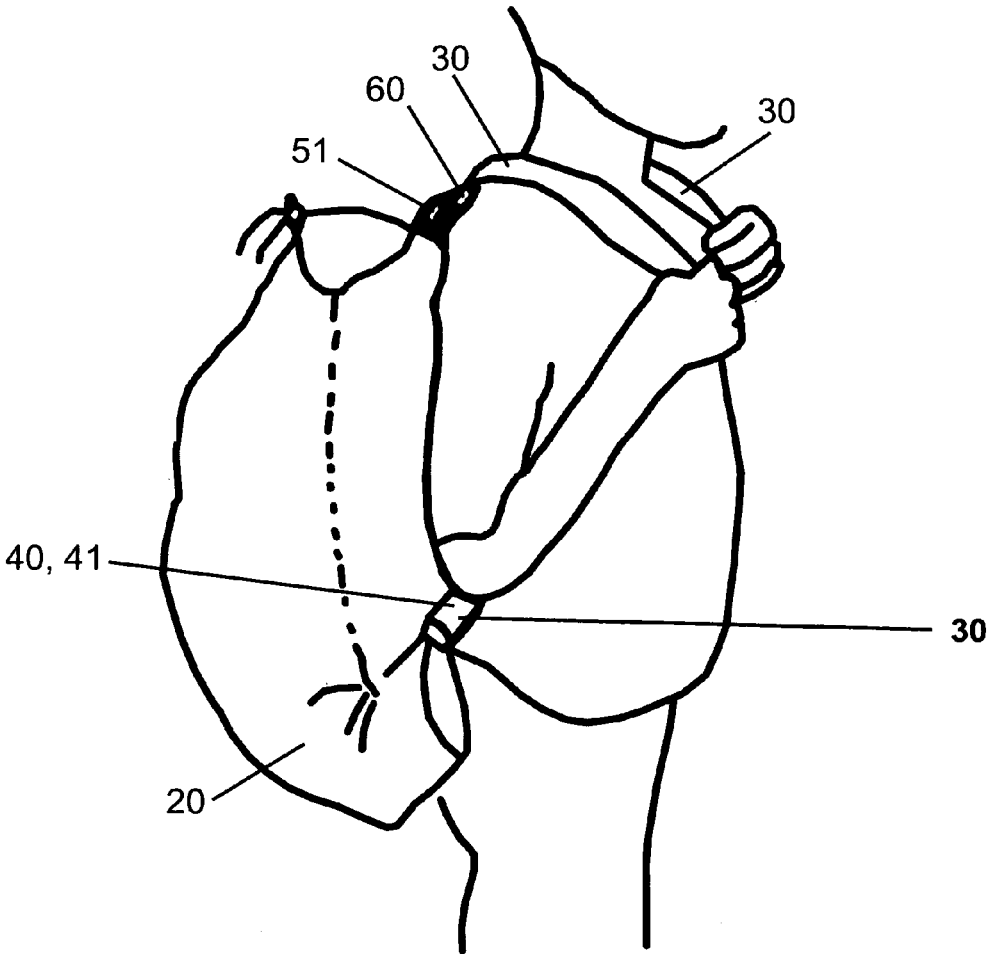
FIG. 7 is a side view of an embodiment showing the person wearing the shoulder straps on both shoulders.
Figure 8:
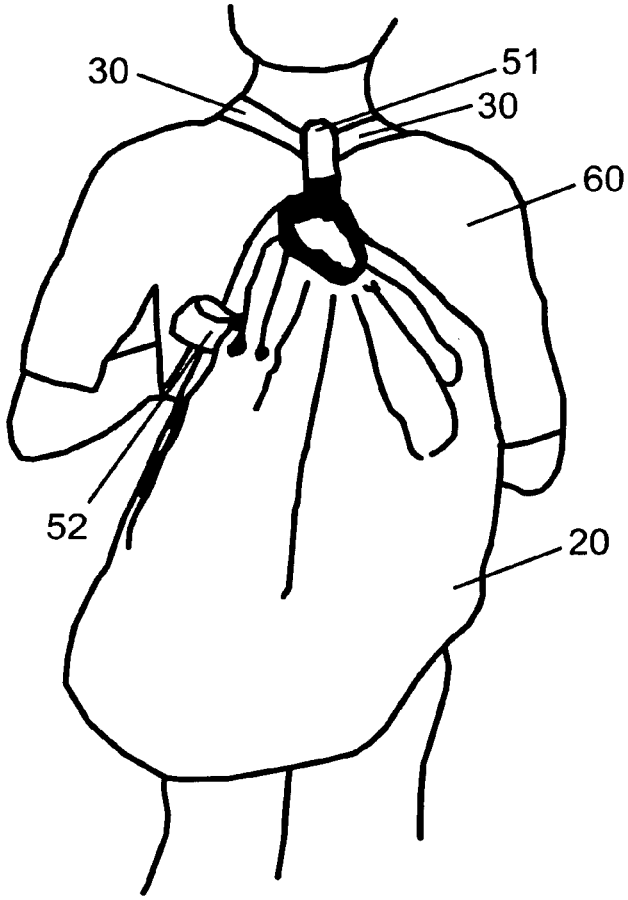
FIG. 8 is a back view of an embodiment showing the shoulder straps construction worn on both shoulders and the embodiment against the person's back.
Figure 9:
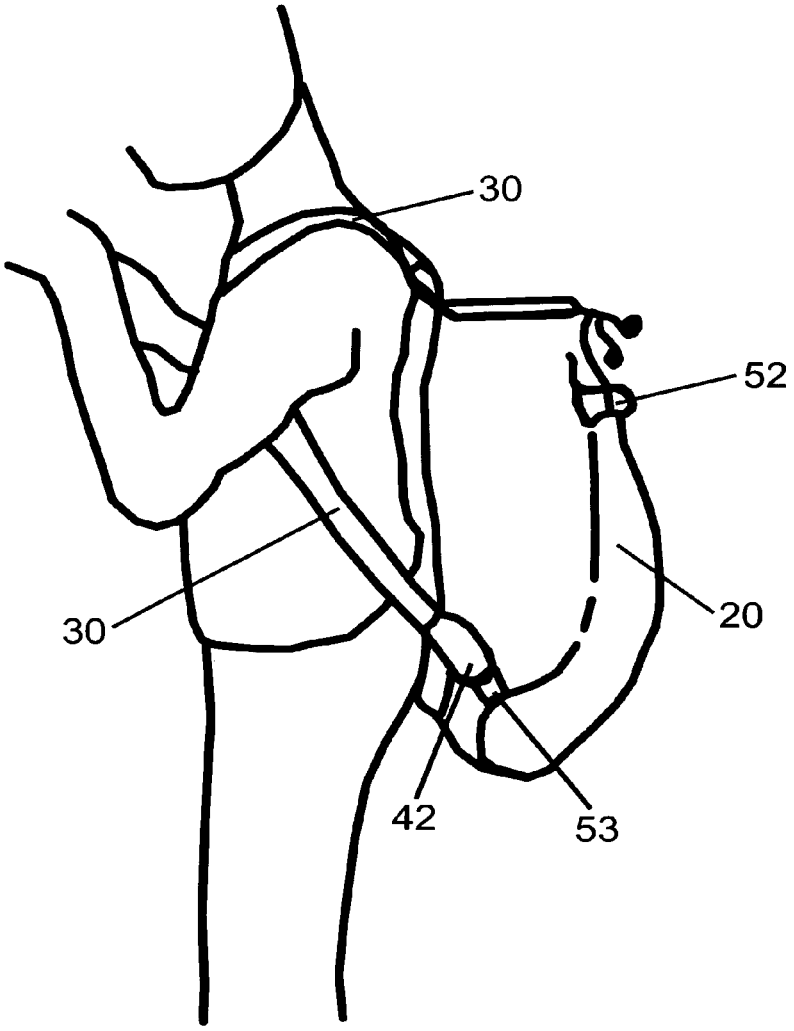
FIG. 9 is a side view of an embodiment showing the shoulder straps worn on both shoulders, and the embodiment facing the person's back.
Figure 10:
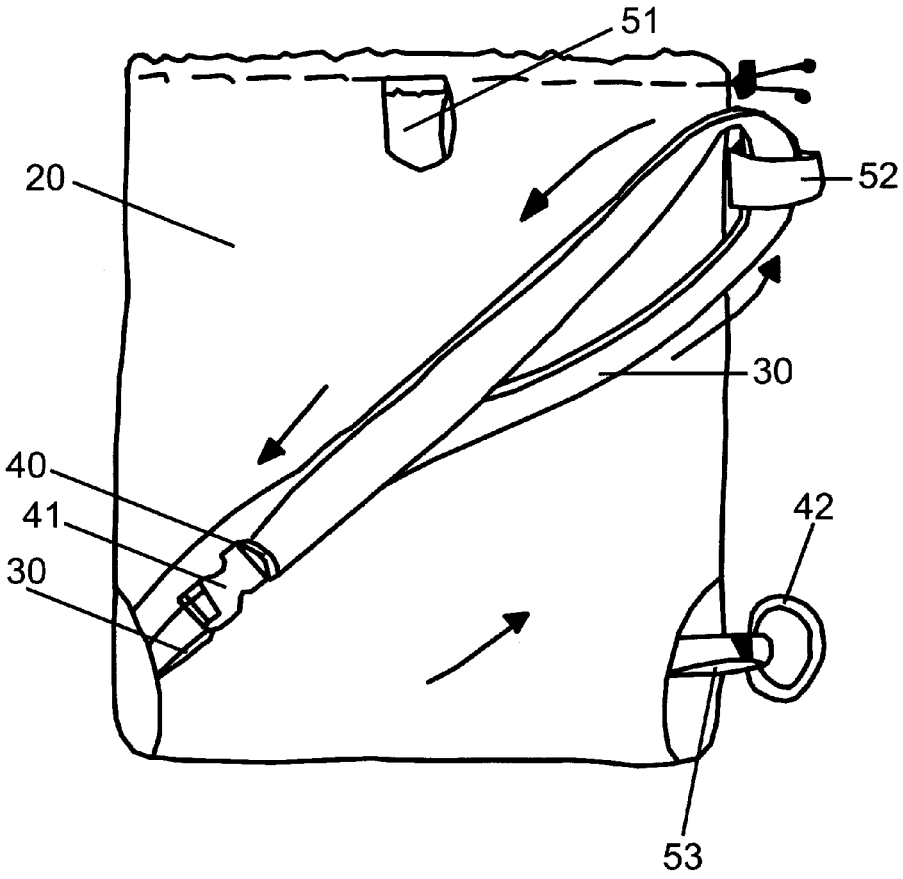
FIG. 10 is a back view of an embodiment showing the shoulder straps construction configured for a person as a second alternative to wear over one shoulder with the shoulder strap that winds around the chest.
Figure 11:
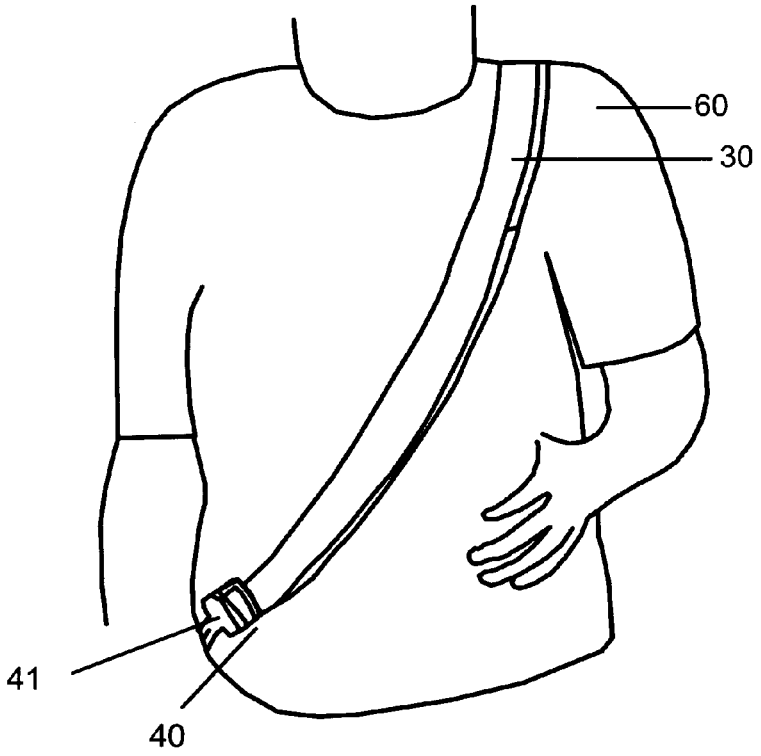
FIG. 11 is a front view of a person showing the shoulder strap worn over one shoulder were the strap winds around the chest.
Figure 12:
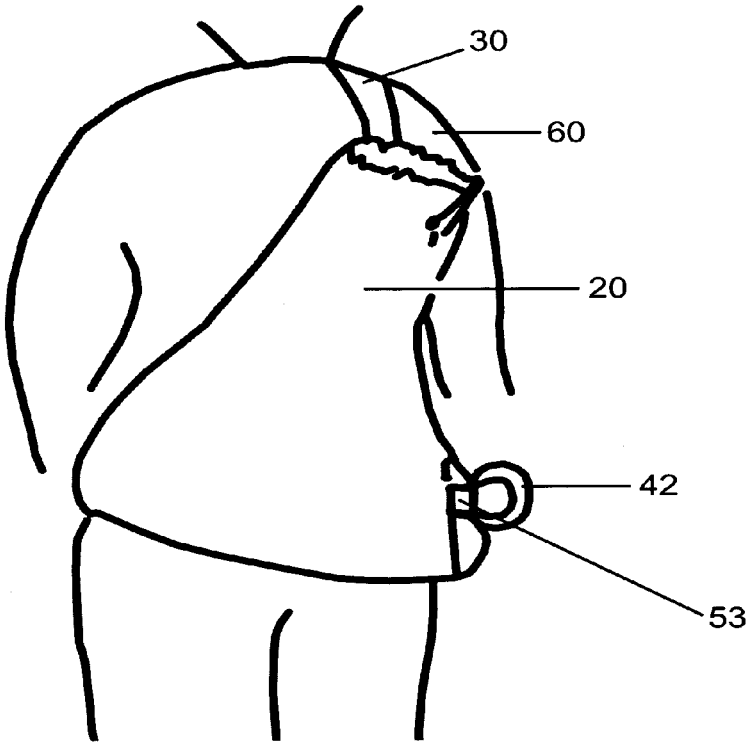
FIG. 12 is a back view of an embodiment showing the shoulder straps worn over one shoulder of the person.
Figure 13A:
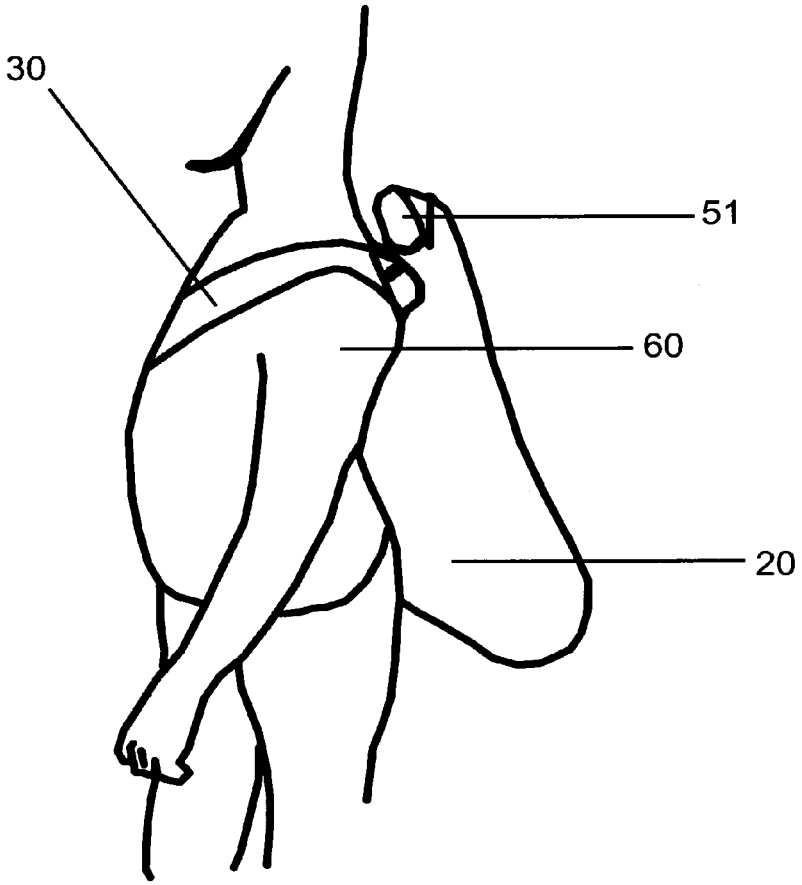
FIG. 13*a* is a side view of a person wearing an embodiment showing the shoulder strap worn over one shoulder were the strap winds around the chest.
Figure 13B:
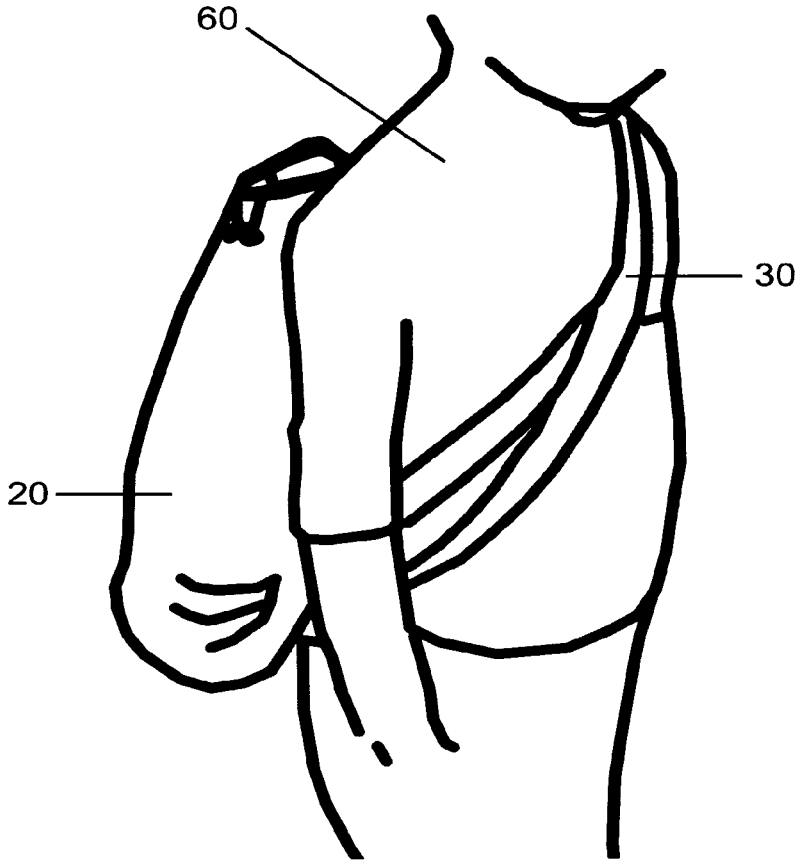
FIG. 13*b* is a front side view of a person wearing an embodiment showing the shoulder strap worn over one shoulder were the strap winds around the chest.
Figure 14A:
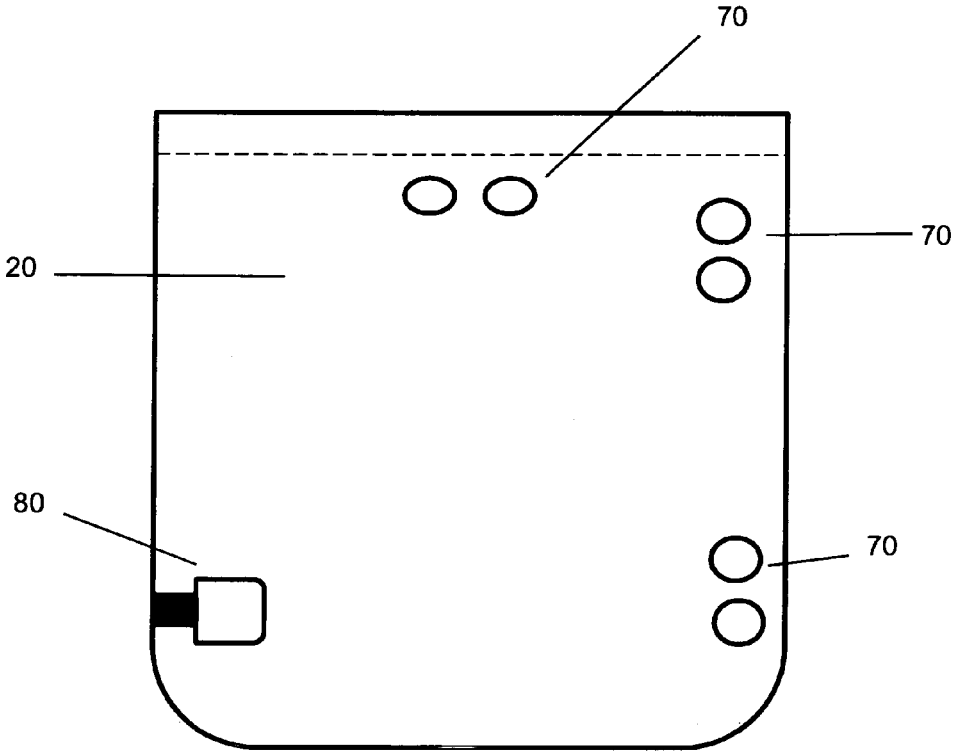
FIG. 14*a* is a front view of an embodiment showing the holes or openings reinforced or not, on the top center, right top side and bottom right side.
Figure 14B:
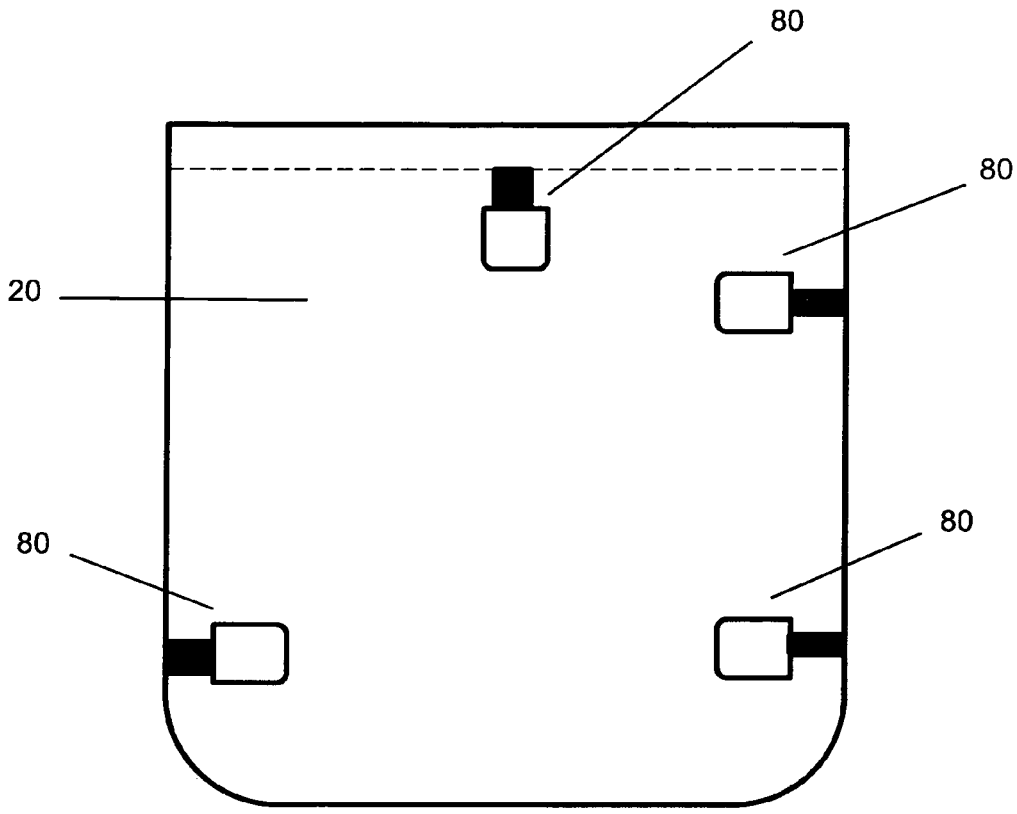
FIG. 14*b* is a front view of an embodiment showing d-rings at the top center, right to side and bottom right side of the main body/outer

The invention claimed is:

1. A two way convertible shoulder strap construction comprising:

a main body having a left side, right side, top, and bottom;

a first main body fastener located at a center of the main body top, a second main body fastener located along an upper portion of the main body right side, and a third main body fastener located at a lower right corner of the main body;

first and second strap portions each affixed at a first end thereof to a lower left corner of the main body, the second strap portion being longer than the first strap portion;

and two releasable strap fasteners respectively affixed at second ends of the first and second strap portions;

wherein the second strap portion passes through the third main body fastener and the first main body fastener and is fastened to the first strap portion, creating a triangular configuration of the strap which allows the user to wear the strap on both shoulders.

2. The strap construction according to claim 1, wherein the second strap portion can be unfastened from the first strap portion and alternatively passed through only the second main body fastener and then fastened to the first strap portion, creating a linear configuration of the strap which allows the user to wear the strap across their chest.

* * * * *